US005718059A

United States Patent [19]

Banerjee et al.

[11] Patent Number: 5,718,059

[45] Date of Patent: Feb. 17, 1998

[54] METHODS FOR DEWATERING SOLID-LIQUID MATRICES

[75] Inventors: Sujit Banerjee, Marietta; Paul Michael Phelan, Decatur; Russell Wilbur Foulke, Atlanta, all of Ga.

[73] Assignee: Institute of Paper Science and Technology, Inc., Atlanta, Ga.

[21] Appl. No.: 719,343

[22] Filed: Sep. 25, 1996

[51] Int. Cl.[6] ..... F26B 5/14

[52] U.S. Cl. ..... 34/398; 100/37; 100/38; 100/302

[58] Field of Search ..... 34/329, 343, 380, 34/397, 398, 399, 424; 162/206, 207, 358.1, 359.1; 110/221, 223, 224; 100/37, 38, 51, 57, 302, 303

[56] References Cited

U.S. PATENT DOCUMENTS

| | | | |
|---|---|---|---|
| 2,209,759 | 7/1940 | Berry | 92/49 |
| 2,679,572 | 5/1954 | Workman | 219/19 |
| 4,324,613 | 4/1982 | Wahren | 162/111 |
| 4,424,613 | 1/1984 | Engels | 26/2 R |
| 4,874,469 | 10/1989 | Pulkowski et al. | 162/359 |
| 4,888,095 | 12/1989 | Gulya et al. | 162/202 |
| 5,101,574 | 4/1992 | Orloff et al. | 34/18 |
| 5,121,683 | 6/1992 | Biefeldt | 100/38 |
| 5,272,821 | 12/1993 | Orloff et al. | 34/110 |
| 5,327,661 | 7/1994 | Orloff | 34/388 |
| 5,353,521 | 10/1994 | Orloff | 34/110 |
| 5,460,085 | 10/1995 | Cappellari et al. | 34/398 X |

OTHER PUBLICATIONS

H.P. Lavery, "High-Intensity Drying Processes—Impulse Drying," Report 2, DOE/CE/40738-T2 (1987).

D.I. Orloff, "Impulse Drying of Paper: A Review of Recent Research," Industrial Energy Technology Conference Proceedings, pp. 110–116, Houston, Texas, 1992.

*Primary Examiner*—Henry A. Bennett
*Assistant Examiner*—Steve Gravini
*Attorney, Agent, or Firm*—Fitch, Even, Tabin & Flannery

[57] ABSTRACT

The present invention provides novel processes for the dewatering of a wide variety of solid-liquid matrices, including primary and secondary sludge, which involve the simultaneous application of pressure and heat to the solid-liquid matrices.

32 Claims, 5 Drawing Sheets

The IPST laboratory simulator

The IPST laboratory simulator

METHODS FOR DEWATERING SOLID-LIQUID MATRICES

BACKGROUND OF THE INVENTION

1. Field of the Invention

The present invention generally relates to the art of the dewatering of solid-liquid matrices, and more particularly pertains to novel processes for removing the water from various types of solid-liquid matrices, including various types of sludge, with the simultaneous application of both pressure and heat to the solid-liquid matrices.

2. Background and Description of Related Art a. Current Methods Employed for Dewatering Solid-Liquid Matrices Solid-liquid matrices from municipal, industrial and other processes are currently dewatered with a room-temperature belt, filter or screw press. These pieces of equipment employ high-pressure processes during which the water is separated from the solid-liquid matrices.

In accordance with the present invention, it has been determined that the application of a hot surface to a solid-liquid matrix simultaneously with the application of pressure to the solid-liquid matrix unexpectedly leads to the greatly enhanced removal of water from the solid-liquid matrix.

b. Description of the Related Art

Each of the documents described hereinbelow discloses processes which are different from the processes of the present invention. Each of these documents is directed to the removal of water from a wet web of paper during paper manufacturing, or to the removal of wrinkles from a web of wrinkled fabric. None of these documents discusses any type of sludge, or other type of solid-liquid matrix, or any process for the dewatering of any type of sludge or other solid-liquid matrix. Unlike sludge, and other types of solid-liquid matrices, which are not webs or fabrics, a wet web of paper has air, rather than water, pushed through the web by the application of pressure. Thus, the processes of the present invention are distinct from that which has been described in the art.

Energy-intensive evaporative drying has been employed in the past to dry wet webs of paper. As is described in H. P. Lavery, "High-Intensity Drying Processes—Impulse Drying", Report 2, DOE/CE/40738-T2 (1987), research in this area has shown that energy can be saved by impulse drying the paper.

"Impulse drying" occurs when a wet paper web passes through the press nip of a pair of rolls, one of which has been heated to a high temperature. A steam layer adjacent to the heated surface grows and displaces water from the wet sheet of paper in a more efficient manner than conventional evaporative drying.

Impulse drying is described in U.S. Pat. No. 4,324,613. Impulse drying is drying by means of heating one of a pair of rolls to a high temperature prior to passing a wet paper web between the pair of rolls. In the method described in this patent, the surface of one of the rolls is heated to a high temperature by an external heat source immediately prior to passing the wet paper web between the heated roll and the other roll. This patent describes the use of solid rolls having at least a surface layer having high thermal conductivity and high thermal diffusivity, such as copper or cast iron, for use as the heated roll.

U.S. Pat. No. 4,324,613 discloses that, in normal cases, a major part of the drying must take place in the press nip, and final drying takes place after the nip. The conductivity of the material of which the heating roll is made must be high so as not to dry at roll surface temperatures higher than necessary. A high conductivity is stated to mean that the heat can be conducted to a greater depth in the roll, and even extracted from a greater depth, which in itself means that a lower roll temperature can be used. U.S. Pat. No. 4,324,613 discloses that the choice of material is limited by the risk of thermal fatigue and: in this respect, at least the surface layer of the roll should be made of a material for which the quantity:

$$\frac{\sigma\mu(t-\nu)\sqrt{\rho}\ c\lambda}{Ea_c}$$

has a high value desirably at least $0.6\times10^6$, where $\sigma\mu$ is the fatigue strength, v is Poisson's ratio, ρ is the density, c is the specific thermal capacity, λ is the thermal conductivity, E is the modulus of elasticity, and $a_c$ is the coefficient of thermal expansion for the material. Copper alloys are stated to have the highest values, approximately $13\times10^6$. However, they are stated to have rather poor resistance to wear and to not be suitable for doctoring. Other stated suitable materials are duralumin ($0.7\times10^6$), cast iron ($0.67\times10^6$–$0.85\times10^6$), steel ($0.8\times10^6$) and nickel (approximately $0.8\times10^6$–$0.9\times10^6$).

In addition to the impact on energy consumption, impulse drying also has an effect on paper sheet structure and properties. Surface fiber conformability and interfiber bonding are enhanced by transient contact with the hot surface of the roll. As the impulse drying process is usually terminated before the sheet is completely dried, internal flash evaporation results in a distinctive density profile through the sheet that is characterized by dense outer layers and a bulky midlayer. For many paper grades, this translates into improved physical properties. The persistent problem with the use of impulse drying, however, is that flash evaporation can result in delamination of the paper sheet. This is particularly a problem with heavy weight grades of paper. This has been a major constraint as to the commercialization of impulse drying.

U.S. Pat. No. 2,209,759 discloses a press roll assembly having a hard, porous surface roller adapted to receive water pressed from a wet web of paper for conveyance of the water away from the web of paper, and having a second roller. During the conveyance of the water away from the wet web of paper, some of the water is thrown from the roller by centrifugal force, and remaining portions of the water are sucked or blown out of the roller at points spaced from the web of paper by a mechanical suction device cooperating with the outer face of the roller. Column 2, Lines 35–39, on Page 3 of this patent discloses the direction of a flame against the porous surface of the first roller after the removal of water from the web of paper to heat the surface of the roller and continuously supply dewatered and heat-treated pores to the nip of the press roll assembly.

U.S. Pat. No. 2,679,572 discloses a roll having a resilient heated surface for use in drying operations. The heating element which is pressed in the roll is in the form of a layer of electro-conductive plastic composition surrounding an insulating layer, and having sufficient resistance to provide the desired heating action when a difference in electrical potential is maintained across the layer. In order to supply electrical energy or potential to the conductive layer, conductor rings of brass or copper are embedded in the conductive layer. Contact points present in the roll are connected to a suitable source of electrical potential so that a difference of potential is maintained across the conductive layer as a shaft rotates. The resistance of the conductive layer causes heat to be generated uniformly thereover, by which the surface of the roll is heated.

U.S. Pat. No. 4,424,613 describes a method and a machine for brushing the pile of a pile fabric, such as a knit fabric, and for removing the wrinkles in a moving web of the material. The wrinkles are removed from the fabric by a wrinkle remover with the application of heat by an infrared heater, and then the fabric is brushed by one or more rotating brushes. The wrinkle remover consists of a pair of rectangular spreader boxes, each of which is connected to a suitable vacuum source through conduit. The vacuum conduit sucks air through an opening to pull the fabric down and maintain it in contact with the bristles of the brushes. As the fabric is being supplied over the spreader boxes, the brushes cam the fabric outward to remove the wrinkles therein as the suction pressure from the vacuum conduit pulls the fabric downward.

U.S. Pat. No. 4,874,469 discloses an apparatus and method in which a formed web is subjected for an extended period of time to increased pressure and temperature, such that fluid within the web is removed therefrom. The apparatus includes a press member (or backing roll), such that when the web passes through the pressing section of the apparatus, fluid is removed from the web, and a heating means which is adjacent to the press member, and which transfers heat to the web. When the web passes through the press section, the web is subjected for an extended period of time to increased pressure and temperature. Water vapor resulting from this high pressure and temperature which is generated in the pressing section of the apparatus during passage of the web therethrough is stated to force the fluid in the liquid phase away from the web. The press member defines a pressing surface which is porous, for inhibiting delamination of the web.

U.S. Pat. No. 4,888,095 discloses a method for extracting water from a wet paper web in a paper making machine using a ceramic foam component which has: (1) a supporting structure; and (2) a water permeable member mounted on the supporting structure which is adapted to support a paper web. The paper web is supported on a moving porous belt, and passes over the water permeable member. When a pressure differential is applied to the wet paper web as it travels over the water permeable member, moisture is extracted from the wet paper web and drains through the water permeable member.

U.S. Pat. No. 5,327,661 and U.S. Pat. No. 5,272,821 disclose a method and apparatus (an electrohydraulic press) for drying a wet web of paper utilizing impulse drying techniques to provide a paper product having a predetermined pattern of delaminated fibers. The wet paper is dried as it passes through the press nip when it is transported through a pair of rolls wherein at least one of the rolls has been heated to an elevated temperature (to a temperature of from about 200° C. to about 500° C.). The heated roll is provided with a planar surface having a predetermined pattern formed on the surface of a material having a low K value of less than about 3000 $w\sqrt{s}/m^2c$, and having a relatively low porosity. The material forming the predetermined pattern of the roll surface is preferably selected from ceramics, polymers, glass, inorganic plastics, composite materials and cermets. The remainder of the roll surface has a high K value of greater than about 3000. The material forming the remainder of the roll surface is preferably selected from steel, molybdenum, nickel and duralimin. The two rolls are urged together to provide a compressive force on the wet paper web as it is transported through the rolls. This method is stated to be useful for the impulse drying of paper webs having an initial moisture level of from about 50% to about 70%. The moisture level of the paper web after being subjected to this impulse drying technique is stated to be in the range of from about 40% to about 60%.

U.S. Pat. No. 5,353,521 and U.S. Pat. No. 5,101,574 disclose a method and apparatus for drying a wet web of paper utilizing impulse drying techniques. The wet paper web is transported through a pair of rolls wherein at least one of the rolls has been heated to an elevated temperature (a temperature of from about 200° C. to about 400° C.) for a residence time of up to about 0.125 seconds. The heated roll is provided with a surface having a low thermal diffusivity of less than about $1\times10^{-6}m^2/s$. The method is stated to be useful for the impulse drying of paper webs having an initial moisture level of from about 50% to about 70%. The moisture level of the paper web after it has been subjected to this impulse drying technique is stated to be in the range of from about 40% to about 60%.

SUMMARY OF THE INVENTION

The present invention provides a method for dewatering a solid-liquid matrix which has a structure comprising simultaneously applying pressure and heat to the solid-liquid matrix for a period of time ranging from about 0.01 seconds to about 20 seconds, the application of pressure being at a pressure ranging from about 45 psi to about 6000 psi, and the application of heat being at a temperature ranging from about 21° C. to about 1000° C.

The present invention also provides a method for dewatering a solid-liquid matrix which does not have a structure comprising:

(1) treating the solid-liquid matrix in a manner such that the weight percent solids content of the solid-liquid matrix increases to a level which provides the solid-liquid matrix with a structure; and (2) simultaneously applying pressure and heat to the solid-liquid matrix resulting from step (1) for a period of time ranging from about 0.01 seconds to about 20 seconds, the application of pressure being at a pressure ranging from about 45 psi to about 6000 psi, and the application of heat being at a temperature ranging from about 21° C. to about 1000° C.

DETAILED DESCRIPTION OF THE INVENTION

1. Definitions

For purposes of clarity, the terms and phrases used throughout this specification and in the appended claims are defined in the manner set forth directly below.

The term "dewatering" as used herein means the removal of water from a solid-liquid matrix.

Figure 1:
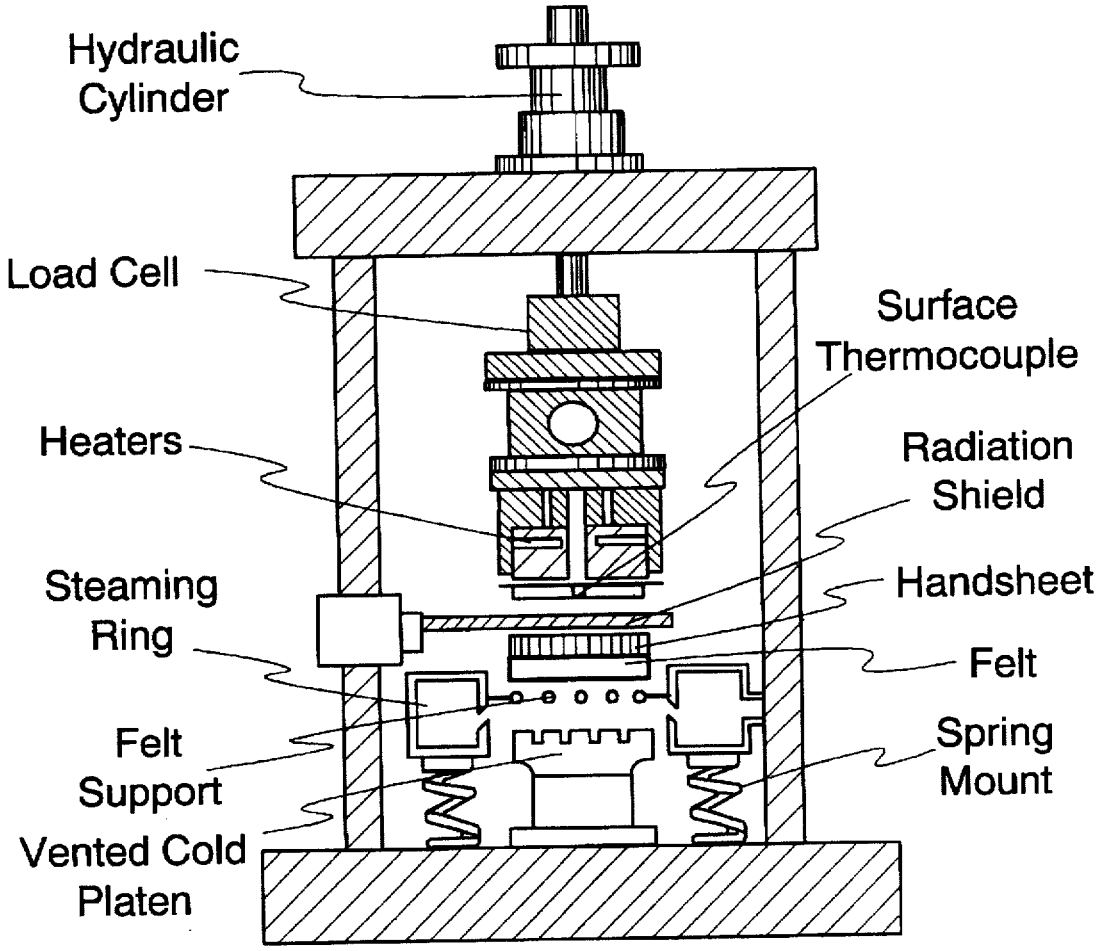
FIG. 1 is a diagram of the electrohydraulic impulse drying laboratory press simulator employed in the experiment described hereinbelow in Example 1, in which paper mill primary clarifier sludge samples were dewatered by the method of the present invention.

The phrases "dwell time" and "nip residence time" as used herein mean the amount of time (generally in seconds or milliseconds) during which sludge or another solid-liquid matrix is brought into contact with the heated rolls of the electrohydraulic impulse drying press simulator shown in FIG. 1, or the amount of time pressure and heat are simultaneously applied to the solid-liquid matrix by other pieces of equipment.

The phrases "impulse drying" and "hot pressing" as used herein mean the simultaneous application of heat and pressure to sludge, or to another solid-liquid matrix, for example, with a piece of equipment, such as a hot press or an impulse dryer, which will simultaneously apply heat and pressure to the solid-liquid matrix.

The phrases "impulse roll" and "impulse roller" as used herein mean a roller which has been heated in some manner to a temperature above room temperature. Such a roller may be added to a conventional filter or belt press in order to carry out the methods of the present invention.

The phrases "municipal sludge," "industrial sludge" and "secondary sludge" as used herein mean sludge derived from municipal and/or industrial operations, which generally consists mostly of organic materials of biological origin, such as debris from microorganisms, which may be admixed with waste solids from industrial processing, which are present in water. The solids portion of municipal sludge generally consists mainly of debris from microorganisms.

The phrases "paper mill sludge" and "primary sludge" as used herein mean sludge generally derived from the primary settling basin of a primary clarifier, which consists principally of non-bonded pieces of fiber and other solids derived from pulp processing and papermaking which are present in water. The solids portion of paper mill sludge taken from a primary clarifier generally consists mainly of fiber and other residual material from the papermaking process.

The phrase "peak pressure" as used herein means the maximum pressure applied to a material with a roller or other device used to transfer heat, and is measured in units of psi.

The phrase "primary clarifier" as used herein means a settling basin where the solids in a flowing water stream settle out. When collected, these solids form primary sludge.

The phrases "solid-liquid mixture" and "solid-liquid matrix" as used herein include any solid-liquid mixture, and mean a material or combination of materials which contains from about 0% to about 100% of organic solid particles, such as organic materials of biological origin, for example, waste solids, from about 0% to about 100% of inorganic solid particles, such as fiber and other solid particles or chemical residues derived from pulp processing and papermaking, and from about 0% to about 100% of water, and various combinations or mixtures thereof. The solid particles present in the solid-liquid mixture or matrix are not bonded together in any manner and, thus, do not form a web or other like structure. Examples of solid-liquid mixtures and solid-liquid matrices include, but are not limited to, various types of sludge, such as paper mill sludge, municipal sludge and industrial sludge, and mixtures or combinations thereof. The solid-liquid mixtures and solid-liquid matrices may have a slimy and/or goopy appearance and/or feel, or may have a dry texture, appearance and/or feel, or may have some other type of appearance and/or feel. Solid-liquid mixtures and solid-liquid matrices which have a slimy and/or goopy appearance and/or feel, and which have been "dewatered" in accordance with methods of the present invention, may have a less slimy and/or goopy appearance and/or feel because some of the liquid which was initially present in the solid-liquid mixtures and solid-liquid matrices will have been removed therefrom by these methods.

2. Description of Invention a. General Information

In one aspect, the present invention provides a method for dewatering a solid-liquid matrix, such as paper mill sludge or municipal sludge, having a structure comprising simultaneously applying pressure and heat to the solid-liquid matrix for a period of time ranging from about 0.01 seconds to about 20 seconds, the application of pressure being at a pressure ranging from about 45 psi to about 6000 psi, and the application of heat being at a temperature ranging from about 21° C. to about 1000° C.

In another aspect, the present invention provides a method for dewatering a solid-liquid matrix which does not have a structure comprising:

(1) treating the solid-liquid matrix in a manner such that the weight percent solids content of the solid-liquid matrix increases to a level which provides the solid-liquid matrix with a structure; and (2) simultaneously applying pressure and heat to the solid-liquid matrix resulting from step (1) for a period of time ranging from about 0.01 seconds to about 20 seconds, the application of pressure being at a pressure ranging from about 45 psi to about 6000 psi, and the application of heat being at a temperature ranging from about 21° C. to about 1000° C.

Specific methods within the scope of the invention include, but are not limited to, the methods discussed in the examples presented below.

Contemplated equivalents of the methods described herein include methods which are similar thereto, and which employ the same or similar general principles and/or conditions, wherein one or more simple variations are made which do not adversely affect the success of the methods.

The methods of the present invention are preferably carried out with the use of an impulse dryer. The most preferred conditions for these methods are a pressure of about 1400 psi, a temperature of about 350° C. and a dwell time of about 0.7 seconds.

The methods of the present invention are an improvement over currently-employed methods for dewatering solid-liquid matrices, including sludge, which generally consist of the pressing of the solid-liquid matrices with a room-temperature press (i.e., dewatering the solid-liquid matrices by squeezing the water therefrom by the application of a great amount of pressure). The methods of the present invention advantageously have been shown to result in about 26% more water being more water being removed from certain solid-liquid matrices in comparison with the dewatering of the same solid-liquid matrices by the currently-employed methods for dewatering solid-liquid matrices.

b. Mechanism of Action

The mechanisms of action of the dewatering of solid-liquid matrices which occur with the processes of the present invention is not currently known. However, two possible mechanisms of action are as follows: (i) the steam pressure generated at the interface of a hot roll and the solid-liquid matrices during the simultaneous application of pressure and heat to the solid-liquid matrices forces out a portion of the water from the solid-liquid matrices in the form of a liquid; and (ii) the viscosity of the water which is present in the solid-liquid matrices is reduced by the application of heat to the solid-liquid matrices.

c. Types of Solid-Liquid Matrices Dewatered

The methods of the present invention may be employed to dewater any type of solid-liquid matrix including, but not limited to, primary sludge and secondary sludge of municipal, industrial or other origin. As described in detail hereinbelow, any type of solid-liquid matrix can be treated in a manner known by those of skill in the art to increase the weight percent solids content of the solid-liquid matrix to a level which provides a structure to the solid-liquid matrix, in order to give the solid-liquid matrix a "body." Methods within the present invention may subsequently be employed to dewater this treated solid-liquid matrix. 3. Utility The methods of the present invention are useful for the dewatering (the removing of the water from) various types of solid-liquid matrices, including primary and secondary sludge from municipal, industrial or other origin. It is beneficial to remove the water from many solid-liquid matrices, such as various types of sludge, in order to reduce the volume of the solid-liquid matrices for easier disposal thereof, in order to decrease the leachability of solid-liquid matrices which are landfilled, and in order to reduce the amount of fuel which is necessary to burn solid-liquid matrices which are disposed of by burning.

4. Conditions and Equipment Employed in Process

In general, the methods of the present invention may be carried out by the methods described below, or by modifications thereof, using readily-available equipment known by those of skill in the art.

In the methods of the present invention, solid-liquid matrices, such as primary and secondary sludge, are dewatered by the simultaneous application of pressure and heat to the solid-liquid matrices. This may be performed, for example, by placing a solid-liquid matrix to be dewatered between a pair of rollers, at least one of which has been heated to a temperature greater than room temperature, with an impulse dryer, with a roll press, with a shoe press, with a hydraulic press, with an electrohydraulic press, with the apparatus shown in FIG 1, or with other like equipment known by those of skill in the art, which are commercially available from sources known by those of skill in the art. Many of these pieces of equipment are described in U.S. Pat. Nos. 2,679,572, 4,324,613, 4,874,469, 5,101,574, 5,327,661 and 5,353,521, each of which is incorporated herein by reference.

A shoe press replaces one of the rolls (cold roll) with a solid, non-moving block of metal of approximately the same curvature as the remaining roll, and up to 20 inches wide. A rubberized, moving blanket isolates the felt from the shoe and is lubricated with oil on the shoe side. Two types of designs are available today. One is an "open" design in which the ends of the shoe are open to the air, and the oil is restrained by a system of scrapers and/or dams. A "closed" system is completely enclosed on the ends, eliminating oil loss and contamination.

There are two major advantages to using a shoe press. First, the nip width can be ten times (or more) the width of a roll press, resulting in a similar increase in dwell time at the same machine speed. Second, the pressure profile can be varied, usually by mounting the shoe on a pivot that can be adjusted, from either a square wave or several versions of ramps as compared to a standard haversine for a roll press.

Generally, solid-liquid matrices which have a weight percent solids content of about 20% or less (a weight percent water content of about 80% or more) do not have a structure (are not of a form which can be held or which can free stand). Some solid-liquid matrices which have a weight percent solids content of between about 20% and about 30%, such as about 25%, or even higher, may not have a structure. Different types of solid-liquid matrices will become structured at different levels of weight percent solids content. The level of weight percent solids content at which a particular solid-liquid matrix will form a structure may be determined by those of skill in the art.

Prior to dewatering solid-liquid matrices according to methods within the present invention, solid-liquid matrices which do not have a structure should be treated in a manner known by those of skill in the art, such as with a conventional, room-temperature belt or filter press, or by mixing the solid-liquid matrices with other, more dry, materials, such as recycled materials, or other cold-pressed solid-liquid matrices, which raises the initial weight percent solids content of the solid-liquid matrices to a level which is sufficient to provide structure to the solid-liquid matrices, so that the solid-liquid matrices may be free-standing, and have a body (a form which can be held). This level will generally be at least about 30% (about 30% or greater), but may be at least about 20%, at least about 25%, or at least about some other value between about 20% and about 30%, or could, in some instances, be a value below about 20% or a value above about 30%, depending upon the type of sludge being dewatered. This level may be determined in a manner known by those of skill in the art. Equipment which may be employed to increase the weight percent solids content of the solid-liquid matrices to the levels described above include any of the many pieces of equipment employed by those of skill in the art to squeeze water out of sludge or other similar materials, such as conventional room-temperature belt or filter presses, or the press roll assemblies described in U.S. Pat. No. 2,209,759 or U.S. Pat. No. 4,888,095, each of which is incorporated herein by reference. This procedure removes water from the solid-liquid matrices through the application of pressure, and in the form of a liquid. These pieces of equipment are commercially available from sources known by those of skill in the art.

According to the methods of the present invention, the piece of equipment employed for applying pressure to a solid-liquid matrix, such as an impulse dryer, and the resulting heated solid-liquid matrix, will each be of a temperature generally ranging from about 21° C. to about 1000° C., preferably ranging from about 100° C. to about 450° C., and more preferably ranging from about 200° C. to about 400° C., with about 350° C. being most preferred. The application of heat to the solid-liquid matrix removes water from the solid-liquid matrix both in the form of steam and in the form of a liquid.

The amount of pressure which will be applied to the solid-liquid matrix will generally range from about 45 psi to about 6000 psi, will preferably range from about 100 psi to about 2000 psi, and will more preferably range from about 300 psi to about 1400 psi, with about 1300 psi being most preferred. The application of pressure to the solid-liquid matrix removes water therefrom in the form of a liquid. Between the range of about 45 psi to about 1400 psi, the data presented hereinbelow in the experimental section show that, where pressure and heat are simultaneously applied to the sludge described therein, the higher the pressure is which is applied to the sludge, the greater the amount of water is which is removed from the sludge.

The amount of time the pressure and heat will each be applied to the solid-liquid matrix will be the same. This time will generally range from about 0.01 seconds to about 20 seconds, will preferably range from about 0.14 seconds to about 10 seconds, and will more preferably range from about 0.25 seconds to about 3 seconds, with about 0.7 seconds being most preferred. However, the optimal time during which the pressure and heat will be applied to a solid liquid matrix will vary depending upon the amount of pressure being applied to the solid-liquid matrix, and the particular temperature being employed. For example, the optimal time will be lower for a solid-liquid matrix which is being dewatered under conditions of a large amount of pressure and a high temperature. The optimal time, pressure and temperatures which should be employed in order to dewater a particular solid-liquid matrix will depend on each of the other conditions being employed, and will depend upon whether or not an extended press nip is present in the apparatus being employed to dewater the solid-liquid matrix. Such optimal time, pressure and temperatures may be determined by methods known by those of skill in the art.

When a normal (non-extended) press nip is present in the apparatus being employed to dewater a solid-liquid matrix according to methods of the present invention, the time during which the pressure and heat will be applied to the solid-liquid matrix will generally not exceed about 10 seconds. However, when an extended press nip is present in such apparatus, this time will depend on the extent to which the press nip has been extended, with the length of time increasing as the press nip is further extended. For an extended press nip, this time will generally not exceed about 20 seconds.

General information concerning impulse drying is described in D. I. Orloff, "Impulse Drying of Paper: A Review of Recent Research," *Industrial Energy Technology Conference Proceedings*, Pg. 110–116, Houston, Tex. (1992), which is incorporated herein by reference.

The conditions and pieces of equipment employed in carrying out the individual steps in the methods of the invention described hereinabove are capable of wide variation.

While the various aspects of the present invention are described herein with some particularity, those of skill in the art will recognize numerous modifications and variations which remain within the spirit of the invention. These modifications and variations are within the scope of the invention as described and claimed herein.

5. Examples

The following examples describe and illustrate the methods of the present invention, as well as other aspects of the present invention, and the results achieved thereby, in further detail. Both an explanation of, and the actual procedures for, the various aspects of the present invention are described where appropriate. These examples are intended to be merely illustrative of the present invention, and not limiting thereof in either scope or spirit. Those of skill in the art will readily understand that variations of the equipment employed in the procedures described in these examples can be used in the methods of the present invention.

In the examples, and throughout the specification, all percents are by weight unless otherwise indicated.

Unless otherwise indicated in a particular example, all starting materials and/or pieces of equipment employed in the examples are commercially available from sources known by those of skill in the art.

All patents and publications referred to in any of the examples, and throughout the specification, are hereby incorporated herein by reference, without admission that such is prior art.

EXAMPLE 1

Dewatering of Paper Mill Primary Clarifier Sludge

In this experiment, samples of paper mill primary clarifier sludge were dewatered by the methods of the present invention. Simultaneous pressure and heat were applied to the sludge at a range of different pressures (0–1500 psi), at a temperature of 350° C. and at three different dwell times (0.24 seconds, 0.7 seconds and 1.5 seconds).

In order to compare the method of the invention employed in this experiment with state-of-the-art conventional cold-press methods for the dewatering of sludge, samples of the same paper mill primary clarifier sludge were additionally pressed at room temperature (20° C.) with a conventional cold press (Ashbrook Corp., Houston, Tex.). The different results obtained by the two different methods, as described hereinbelow, show the significant advantages of dewatering mill sludge by the methods of the present invention in comparison with state-of-the-art conventional cold-press methods.

A sample of primary sludge was obtained from Riverwood International in Macon, Ga. In order to give this sludge a "body" (a structure) and, thus, to increase the weight percent solids content thereof to about 30%, the sludge sample was belt-pressed with a conventional, room-temperature belt press from the primary clarifier at the Riverwood Macon Mill in Macon, Ga., and was then characterized as having 30% solids (30 weight percent solids of the total weight of the sludge sample).

In order to initially compare the methods of the present invention with currently-employed methods for dewatering solid-liquid mixtures, a sample of this belt-pressed mill sludge was sent to Ashbrook Corp., where this sample was dewatered by conventional, state-of-the-art, room-temperature, belt-press methods using a 14-roll belt press. This had the effect of increasing the weight percent solids content of the sludge sample from 30% to 39.0%. The Ashbrook Corp. belt press device is the state-of-the-art device in belt-press technology. The results of this belt pressing of the paper mill primary clarifier sludge samples with the Ashbrook Corp. device showed that cold belt pressing of this sludge with state-of-the-art equipment could achieve a maximum solids level of only 39%.

After a primary sludge sample from Riverwood International equivalent to the sludge pressed to a weight percent solids content of 39% by Ashbrook Corp. was prepared in the manner described above (given a body), a series of simulations of impulse drying were conducted wherein the electrohydraulic impulse drying press simulator shown in FIG. 1 was employed to dewater the sludge by impulse drying under the conditions described hereinbelow. This press simulator was obtained from MTS Systems Corp. (Guntersville, Ala.). For comparison purposes, other of these sludge samples were dewatered under the same conditions, with the exception of the temperature being at room temperature (20° C.).

FIG. 1 is a diagram of the electrohydraulic impulse drying press simulator employed in this experiment. The apparatus was designed to simulate the transient mechanical and thermal conditions experienced during the processes of impulse drying and double felted pressing. A programmable signal generator allows the electrohydraulic press to simulate a pressure history that the sludge would experience in a commercial impulse dryer configured on a long nip shoe press. Thermal conditions were simulated using a steel platen heated to the operating temperature of the process being employed (350° C.).

The electrohydraulic impulse drying press simulator removes water from sludge in the form of a liquid, and also in the form of a vapor, and includes a frame on which a hydraulic cylinder is mounted. The piston of the hydraulic cylinder actuates a heating head through a load cell. A heating platen, which is made of steel material, is present at the lower extremity of the heating head. Electric resistance heaters are disposed within the heating head for heating the platen, and a surface thermocouple is disposed in the heating head for measuring the surface temperature of the platen surface. A stand holds a felt pad against which the heating head is actuated by the hydraulic cylinder. Part of the water removal occurs as the result of steam formation and venting at the hot platen-vapor interface resulting from the hot pressing. The steam layer adjacent to the heated surface Brows, and displaces water from the sludge in the form of a liquid.

After the laboratory press simulator was preheated, the hydraulic system was activated, resulting in the peak pressures described hereinbelow. The paper mill primary clarifier sludge samples were placed in the press simulator between the felt and the heated platen of the press simulator. A disposable blotter was used between the sludge samples and the felt to prevent the imbedding of the sludge samples in the felt. The felt ingoing moisture content (moisture content of the felt prior to the dewatering of the paper mill sludge samples) was 16% (16 weight percent moisture of the total weight of the felt).

The experimental conditions employed in this experiment were as follows:

| Experimental Condition | Value |
|---|---|
| Peak Pressures Tested | 0–1500 psi |
| Hot Platen Temperature | 20° C. (room temperature) and 350° C. |
| Dwell Times Tested | 0.24 seconds, 0.7 seconds and 1.5 seconds |

Sludge samples which had been subjected to impulse drying simulation were oven-dried, and then tested for solids content (as a percent weight of the total sludge sample). The sludge samples, and the blotters and felts of the electrohydraulic impulse drying press simulator, were weighed before cold pressing or impulse drying, after cold pressing or impulse drying, and after oven drying. From this weight data, water removal was calculated with the use of the following formulas:

Symbols and Terms:

$S_{in}$=Sludge ingoing weight $S_{out}$=Sludge outgoing weight $S_{od}$=Sludge oven dry weight $B_{od}$=Blotter oven dry weight $BS_{od}$=Blotter+Sludge oven dry weight $BS_{out}$=Blotter+Sludge outgoing weight $F_{in}$=Felt ingoing weight $F_{out}$=Felt outgoing weight $F_{od}$=Felt oven dry weight $S_I$=Percent sludge ingoing solids content $S_O$=Percent sludge outgoing solids content $R_I$=Water receiver ingoing moisture $R_O$=Water receiver outgoing moisture LW=Percent liquid water removed Ingoing=Prior to being dewatered Outgoing=After being dewatered Formulas:

$$S_I = 100 \times \frac{(S_{od} + BS_{od} - B_{od})}{S_{in}}$$

$$S_o = 100 \times \left( \frac{S_{od}}{S_{out}} \right)$$

$$R_I = 100 - 100 \times \left( \frac{F_{od}}{F_{in}} \right)$$

$$R_o = 100 - 100 \times \left( \frac{F_{od}}{\left( F_{out} + BS_{out} - B_{od} - \left( \frac{BS_{od} - B_{od}}{S_o} \right) \right)} \right)$$

$$LW = 100 \times \left( \frac{\text{Receiver Weight Gain}}{\text{Sludge Weight Loss}} \right)$$

$$= 100 \times \left[ \frac{F_{out} + BS_{out} - B_{od} - (BS_{od} - B_{od})/S_o - F_{in}}{S_{in} - S_{out} - (BS_{od} - B_{od})(S_o)} \right]$$

Figure 2:
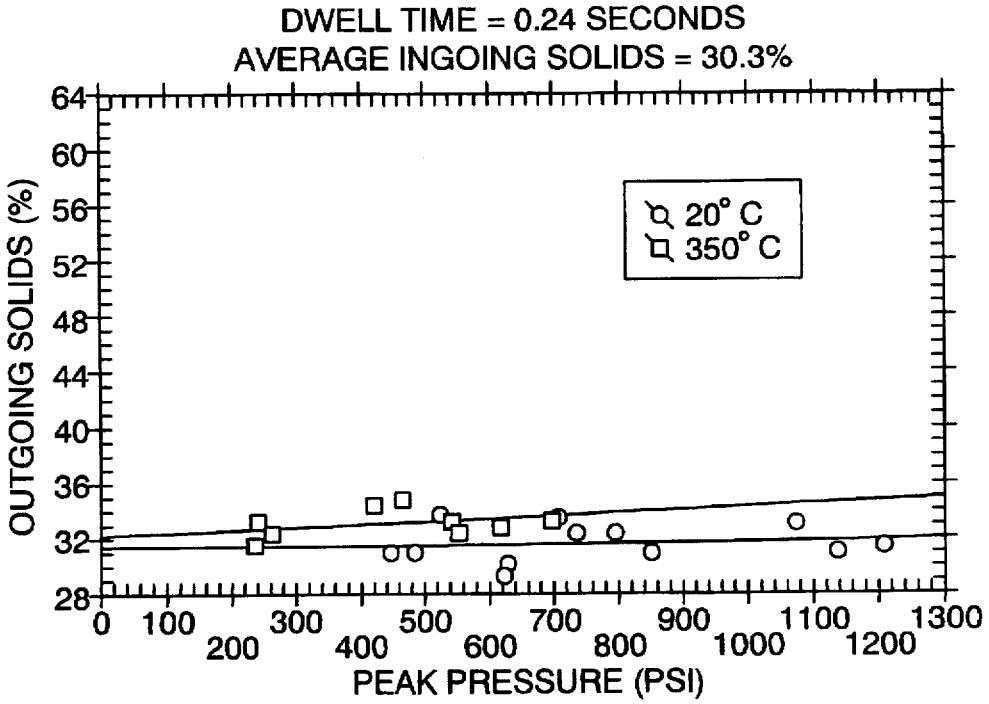
FIG. 2 is a graph of peak pressure (in psi units) versus the percent of outgoing solids content of paper mill primary clarifier sludge samples dewatered at a dwell time of 0.24 seconds and at two different temperatures (room temperature (20° C.) and 350° C.) in the experiment described in Example 1 hereinbelow.
Figure 3:
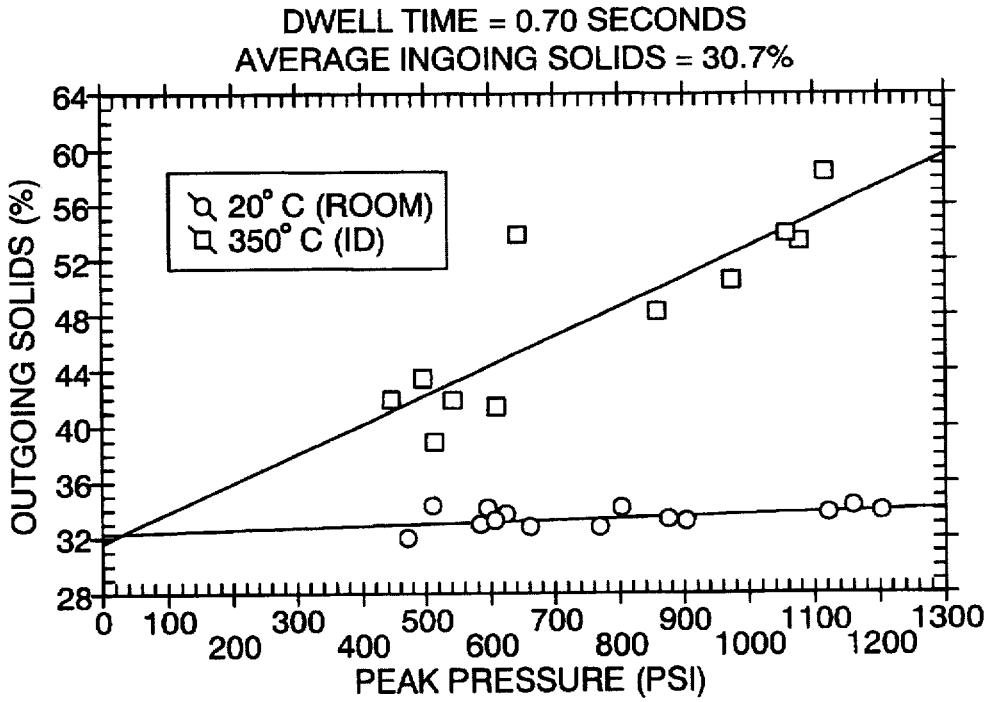
FIG. 3 is a graph of peak pressure (in psi units) versus the percent of outgoing solids content of paper mill primary clarifier sludge samples dewatered at a dwell time of 0.7 seconds and at two different temperatures (room temperature (20° C.) and 350° C.) in the experiment described in Example 1 hereinbelow.
Figure 4:
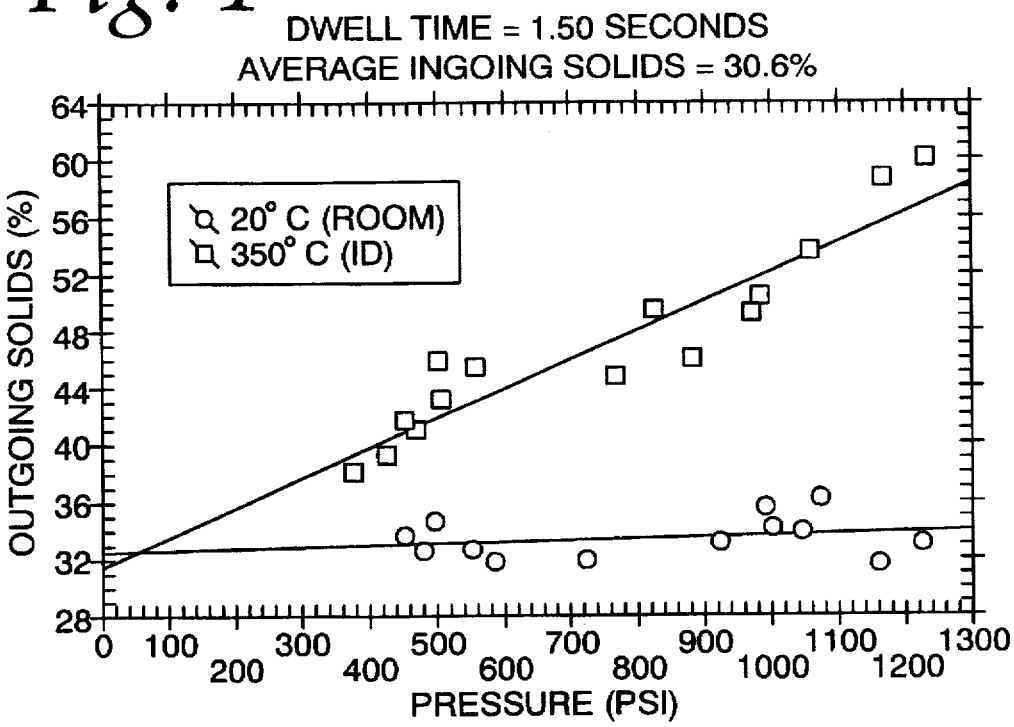
FIG. 4 is a graph of peak pressure (in psi units) versus the percent of outgoing solids content of paper mill primary clarifier sludge samples dewatered at a dwell time of 1.5 seconds and at two different temperatures (room temperature (20° C.) and 350° C.) in the experiment described in Example 1 hereinbelow.

FIGS. 2, 3 and 4 graphically show the weight percent solids content of the outgoing (after being dewatered in the manners described above) sludge samples of the total weight of the outgoing sludge samples after the sludge samples were dewatered in the manners described above. These figures show that there is a direct correlation between the percent of outgoing solids of the sludge samples and the percent of water removed from the sludge samples.

FIG. 2 shows that, at the dwell time of 0.24 seconds, there was not a substantial increase in the percent of outgoing solids of the sludge samples at the two pressures and temperatures tested. However, FIG. 3 shows that, when the dwell time was increased from 0.24 seconds to 0.70 seconds, there was a significant increase in the percent of outgoing solids of the sludge samples tested at a temperature of 350° C., and that, at a temperature of 350° C., the percent of outgoing solids of the sludge samples increased significantly as the pressure was increased.

FIG. 4 shows that similar results were obtained to those shown in FIG. 3 when the dwell time was further increased to 1.50 seconds. At the higher temperature of 350° C., a significant amount of steam was formed and vented during pressing. Some of the water removed from the sludge samples may have been the result of flash drying in the press. (As the impulse drying is terminated before the sludge samples are completely dried, water remaining in the sludge may "flash" to vapor during nip decompression).

Figure 5:
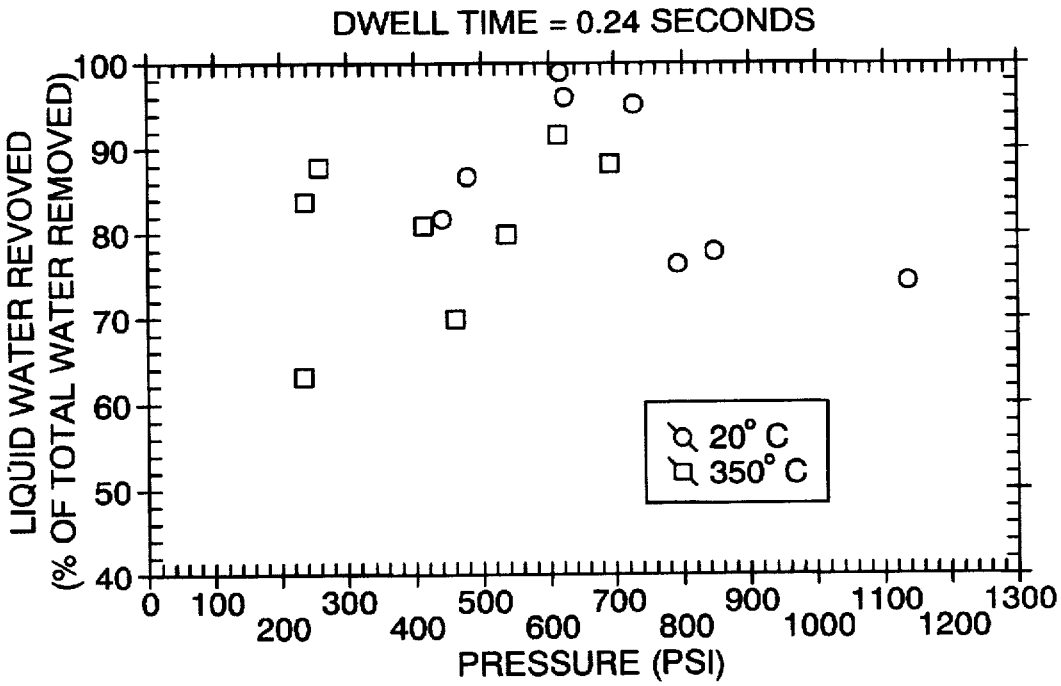
FIG. 5 is a graph of peak pressure (in psi units) versus the percent felt moisture gain for the felt of the electrohydraulic impulse drying laboratory press simulator shown in FIG. 1 at a dwell time of 0.24 seconds and at two different temperatures (room temperature (20° C.) and 350° C.) in the experiment described in Example 1 hereinbelow.
Figure 6:
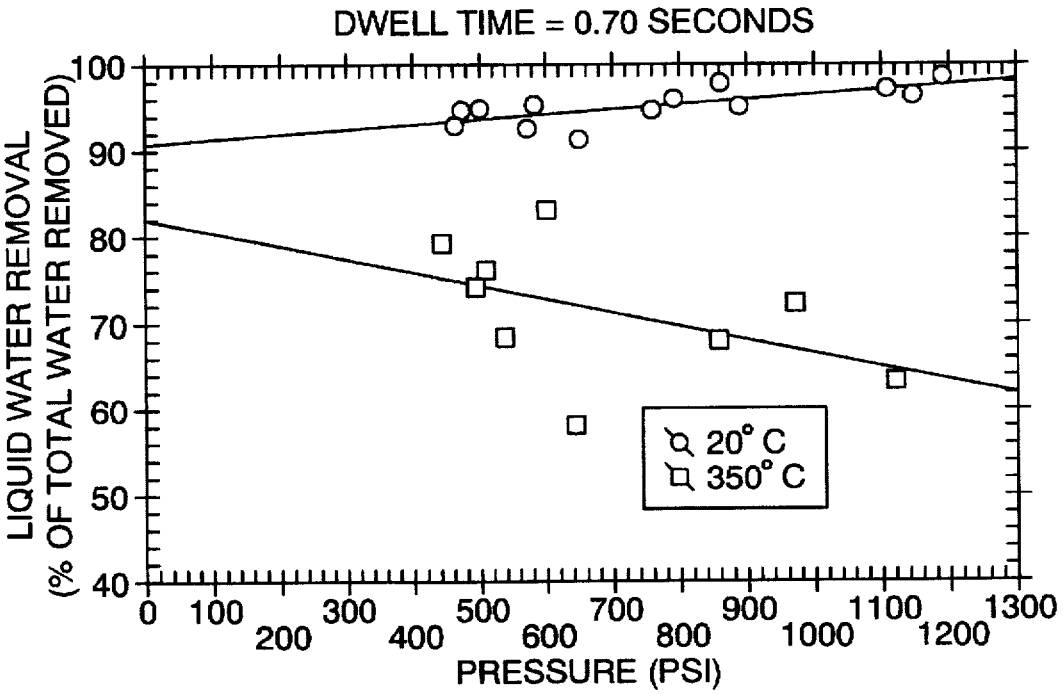
FIG. 6 is a graph of peak pressure (in psi units) versus the percent felt moisture gain for the felt of the electrohydraulic impulse drying laboratory press simulator shown in FIG. 1 at a dwell time of 0.7 seconds and at two different temperatures (room temperature (20° C.) and 350° C.) in the experiment described in Example 1 hereinbelow.
Figure 7:
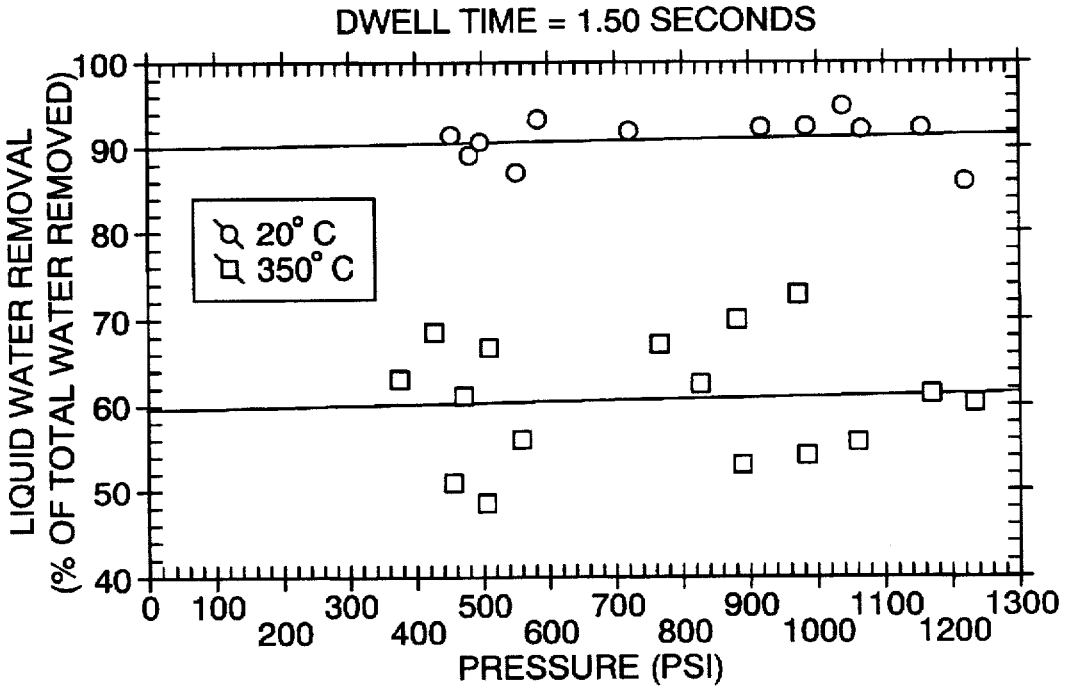
FIG. 7 is a graph of peak pressure (in psi units) versus the percent felt moisture gain for the felt of the electrohydraulic impulse drying laboratory press simulator shown in FIG. 1 at a dwell time of 1.5 seconds and at two different temperatures (room temperature (20° C.) and 350° C.) in the experiment described in Example 1 hereinbelow.

FIGS. 5, 6 and 7 each show the percent moisture gain in the felt and blotter (the percent weight increase in the moisture content of the felt and blotter of the total felt and blotter weight) for the felt and blotter of the laboratory press simulator employed in this experiment at the two different temperatures of 20° C. and 350° C., and different pressures, tested. This shows the amount of water which was absorbed by the felt/blotter system of the press simulator during the impulse drying of the sludge samples. When steam is not formed and vented during pressing, there is a direct correlation between the percent moisture gain in the felt and blotter and the percent of water removed from the sludge samples. The percent moisture gain in the felt and blotter was calculated as a percentage of the water lost by the sludge.

FIG. 5 shows that, at a dwell time of 0.24 seconds, there was not much difference with respect to the percent moisture gain in the felt and blotter between sludge samples cold pressed at room temperature (20° C.) and sludge samples heated to a temperature of 350° C. with a hot platen at a temperature of 350° C.

FIG. 6 shows that, when the dwell time was increased from 0.24 seconds to 0.7 seconds, for sludge samples heated to a temperature of 350° C., there was significantly less percentage water absorbed by the felt and blotter, with up to 40% of the water being lost as steam. FIG. 6 also shows that at a temperature of 350° C., the percent moisture gain in the felt and blotter decreases significantly as the pressure increases.

FIG. 7 shows that, when the dwell time was increased from 0.7 seconds to 1.50 seconds, for sludge samples heated to a temperature of 350° C., there was significantly less percentage water absorbed by the felt and blotter in comparison with sludge samples which were pressed at room temperature, with up to 40% of the water being lost as steam. Unlike FIG. 6, however, FIG. 7 does not show, at a temperature of 350° C., a significant decrease in the percent moisture gain in the felt and blotter as the pressure increases.

The conclusions which may be drawn from this experiment are as follows:

(1) The dewatering of paper mill primary clarifier sludge samples by the method of the invention described in this experiment (at a temperature of 350° C.) resulted in the removal of significantly more water from the mill sludge samples than that which was removed from the same mill sludge samples by the conventional cold pressing of the mill sludge samples at room temperature (20° C.), even when state-of-the-art belt-press devices were employed. The percent of outgoing solids content of the mill sludge samples (weight percent solids content of the mill sludge samples after being dewatered) increases by from about three to about twenty-four percent when the method of the invention described in the experiment (at a temperature of 350° C.) is employed in comparison with the conventional cold pressing of the mill sludge samples at room temperature (20° C.). From about 5% to about 40% of the water removed from the mill sludge samples in accordance with the methods of the invention is in the form of steam, with more steam being generated as the dwell time and pressure are increased.

(2) As is shown in FIG. 2, at the shorter dwell time of 0.24 seconds, the method of the invention described in this experiment (at a temperature of 350° C.) offered some advantage over the conventional cold press methods for dewatering mill sludge samples at room temperature (20° C.).

(3) As is shown in FIG. 3, at the increased dwell time of 0.70 seconds, the advantages of the method of the invention described in this experiment (at a temperature of 350° C.) in comparison with conventional cold press methods for dewatering sludge at room temperature (20° C.) were significant. The benefits of heating the mill sludge samples at this dwell time at a temperature of 350° C increased with increasing pressure (i.e., more water was removed from the sludge samples at a dwell time of 0.70 seconds and at a temperature of 350° C. as the pressure was increased from 0 to 1300 psi). As is shown in FIG. 3, at a pressure of 1300 psi, the outgoing mill sludge samples had a content which was about 60% solid, as compared with outgoing mill sludge samples having a content which was about 34% solid for sludge samples pressed for the same dwell time, and at the same pressure, but at room temperature (20° C.). Further, the solids content of the sludge samples initially dewatered with the state-of-the-art Ashbrook Corp. room-temperature belt-press device was only 39%. Approximately one-third of the water removed from the mill sludge samples by impulse drying in accordance with the method of the invention described in this experiment (at a temperature of 350° C.) was removed in the form of steam, with the rest of the water being removed from the mill sludge samples in the form of a liquid, and being absorbed from the mill sludge samples by the felt of the press simulator. Thus, excluding the water removed from the mill sludge samples in the form of steam, dewatering of the mill sludge samples at a temperature of 350° C. resulted in about a 17% increase in water removal from the mill sludge samples in comparison with cold pressing water from the same mill sludge samples at room temperature (20° C.).

(4) As is shown in FIG. 4, similar results were obtained as described above for a dwell time of 0.70 seconds when a dwell time of 1.5 seconds was employed. At a pressure of 1300 psi, a temperature of 350° C. and a dwell time of 1.5 seconds, the outgoing mill sludge samples had a content which was about 58% solid. In contrast, the same mill sludge samples which were pressed for the same dwell time, and at the same pressure, but at room temperature (20° C.) resulted in outgoing mill sludge samples having a content which was about 34% solid.

EXAMPLE 2

Dewatering of Municipal/Industrial Sludge

In this experiment, wet sludge consisting of mixed municipal and industrial streams was obtained from the City of Milwaukee. In order to test the methods of the present invention on sludge samples having a higher initial weight percent solids content (weight percent solids content prior to being dewatered according to the methods of the present invention) than the sludge samples described in Example 1, one part of this wet sludge was mixed with two parts of dry sludge (recycled material). This produced a sludge having an ingoing (before impulse drying) weight percent solids content of about 75%.

The same impulse drying equipment and techniques employed in Example 1 were employed in this experiment.

In the first part of this experiment, a dwell time of 0.7 seconds was employed, and the pressure was varied from 200 psi to 1400 psi. This part of the experiment was performed once at a temperature of 23° C., and a second time at a temperature of 350° C.

In a second part of this experiment, a temperature of 350° C. was employed, five different dwell times were employed (0.7 seconds, 0.6 seconds, 0.5 seconds, 0.35 seconds and 0.14 seconds), and the pressure was varied from 200 psi to 1400 psi.

Figure 8:
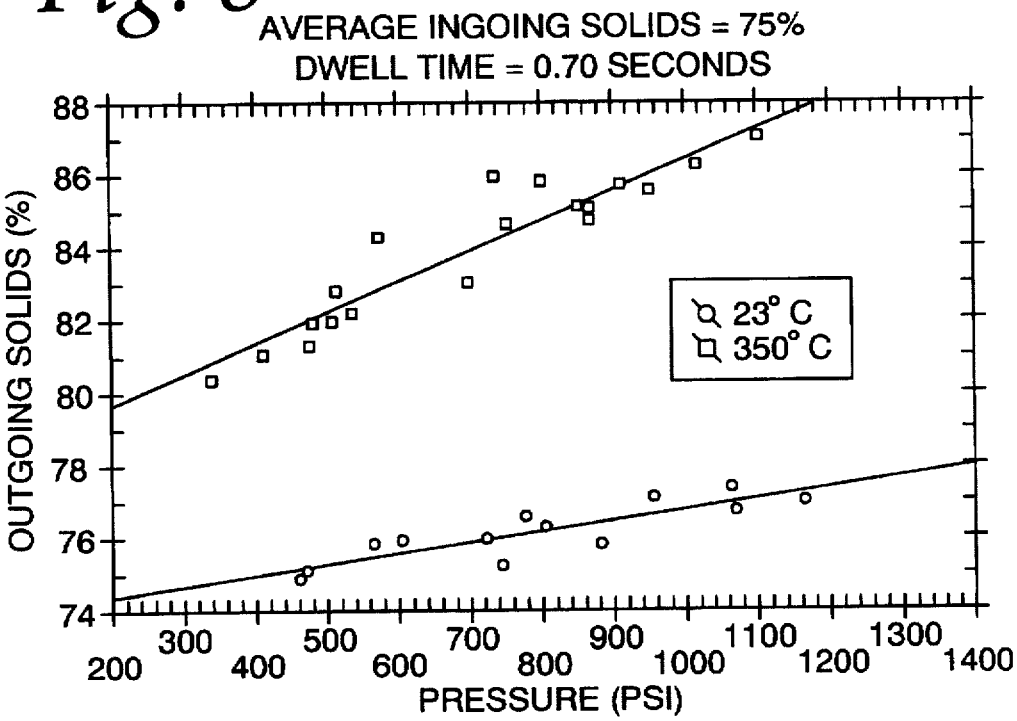
FIG. 8 is a graph of peak pressure (in psi units) versus the percent of outgoing solids content of municipal/industrial sludge samples dewatered at a dwell time of 0.7 seconds and at two different temperatures (23° C. and 350° C.) in the experiment described in Example 2 hereinbelow.
Figure 9:
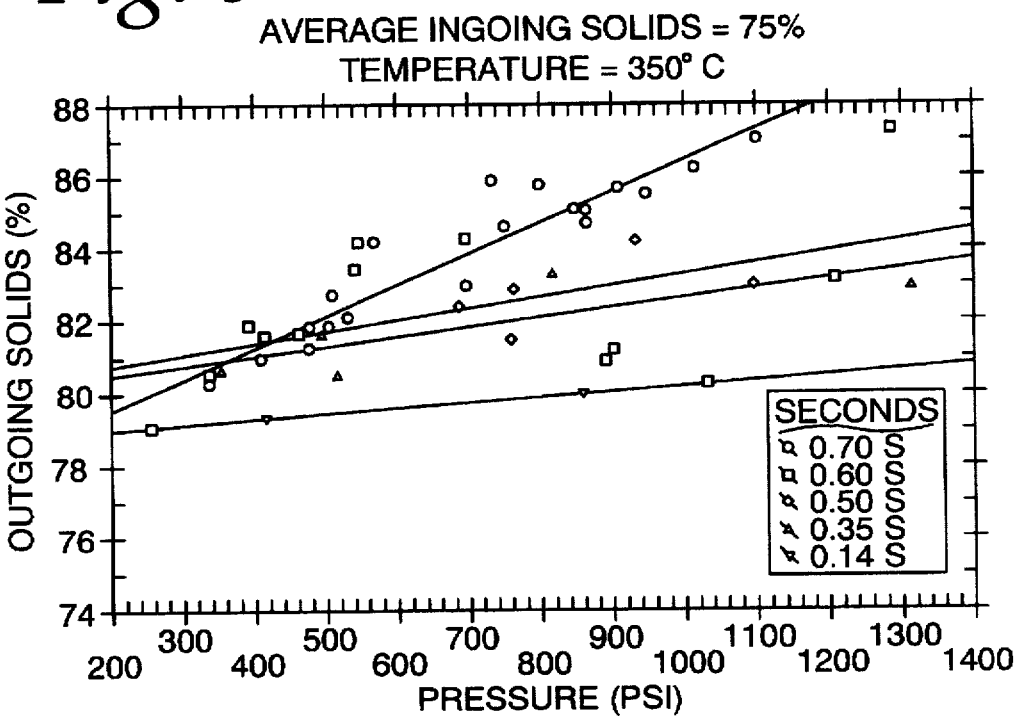
FIG. 9 is a graph of peak pressure (in psi units) versus the percent of outgoing solids content of municipal/industrial sludge samples dewatered at five different dwell times (0.7 seconds, 0.6 seconds, 0.5 seconds, 0.35 seconds and 0.14 seconds) and at a temperature of 350° C. in the experiment described in Example 2 hereinbelow.

The results of this experiment are present in FIGS. 8 and 9.

FIG. 8 is a graph which shows the results of the first part of this experiment. FIG. 8 shows that, at a temperature of 350° C., a dwell time of 0.7 seconds and a pressure of about 1175 psi, the outgoing (after impulse drying) solids content of the municipal sludge samples was about 88%. FIG. 8 also shows that, at a temperature of 23° C., a dwell time of 0.7 seconds and a pressure of about 1400 psi, the percent of outgoing solids was increased from about 75% to about 78%. In both cases (at the two different temperatures), a proportional increase in the outgoing solids content of the municipal sludge samples as a percent weight of the total content of the outgoing sludge samples is seen as the pressure is increased, with a more significant increase in the outgoing solids content of the municipal sludge samples occurring at the higher temperature of 350° C.

FIG. 9 is a graph which shows the results of the second part of this experiment. FIG. 9 shows that, at a temperature of 350° C., a dwell time of 0.7 seconds, and a pressure of about 1175 psi, the percent of outgoing solids content of the municipal sludge samples was increased from about 75% to about 88%. FIG. 9 also shows that, at each of the five dwell times tested, there was a proportional increase in the percent of outgoing solids content of the municipal sludge samples as the pressure was increased, with more significant increases occurring as the dwell time was increased from 0.14 seconds to 0.70 seconds.

The foregoing examples are provided to enable one of ordinary skill in the art to practice the present invention. These examples are merely illustrative, however, and should not be read as limiting the scope of the invention as it is claimed in the appended claims.

While the present invention has been described herein with some specificity, and with reference to certain preferred embodiments thereof, those of ordinary skill in the art will recognize numerous variations, modifications and substitutions of that which has been described which can be made, and which are within the scope and spirit of the invention. For example, the specific solid-liquid matrix dewatering effect observed may vary according to, and depending upon, the particular type of solid-liquid matrix selected for dewatering, as well as upon the type of equipment employed. Such expected variations and/or differences in the results are contemplated in accordance with the objects and practices of the present invention. It is intended therefore that all of these modifications and variations be within the scope of the present invention as described and claimed herein, and that the invention be limited only by the scope of the claims which follow, and that such claims be interpreted as broadly as is reasonable.

What is claimed is:

1. A method for dewatering a solid-liquid matrix which has a structure comprising simultaneously applying pressure and heat to the solid-liquid matrix for a period of time ranging from about 0.01 seconds to about 20 seconds, the application of pressure being at a pressure ranging from about 45 psi to about 6000 psi, and the application of heat being at a temperature ranging from about 21° C. to about 1000° C.

2. The method of claim 1, wherein the solid-liquid matrix is sludge.

3. The method of claim 2, wherein the sludge is primary sludge.

4. The method of claim 2, wherein the sludge is secondary sludge.

5. The method of claim 2, wherein the sludge is a mixture of primary and secondary sludge.

6. The method of claim 1, wherein the pressure and heat are applied to the solid-liquid matrix by an impulse dryer.

7. The method of claim 1, wherein the solid-liquid matrix has an initial weight percent solids content of at least about 20%.

8. The method of claim 1, wherein the application of pressure is at a pressure ranging from about 45 psi to about 2000 psi, the application of heat is at a temperature ranging from about 100° C. to about 450° C. and the pressure and heat are applied for a period of time ranging from about 0.14 seconds to about 10 seconds.

9. The method of claim 2, wherein the application of pressure is at a pressure ranging from about 45 psi to about 2000 psi, the application of heat is at a temperature ranging from about 100° C. to about 450° C. and the pressure and heat are applied for a period of time ranging from about 0.14 seconds to about 10 seconds.

10. The method of claim 3, wherein the application of pressure is at a pressure ranging from about 45 psi to about 2000 psi, the application of heat is at a temperature ranging from about 100° C. to about 450° C. and the pressure and heat are applied for a period of time ranging from about 0.14 seconds to about 10 seconds.

11. The method of claim 4, wherein the application of pressure is at a pressure ranging from about 45 psi to about 2000 psi, the application of heat is at a temperature ranging from about 100° C. to about 450° C. and the pressure and heat are applied for a period of time ranging from about 0.14 seconds to about 10 seconds.

12. The method of claim 6, wherein the application of pressure is at a pressure ranging from about 45 psi to about 2000 psi, the application of heat is at a temperature ranging from about 100° C. to about 450° C. and the pressure and heat are applied for a period of time ranging from about 0.14 seconds to about 10 seconds.

13. The method of claim 7, wherein the application of pressure is at a pressure ranging from about 45 psi to about 2000 psi, the application of heat is at a temperature ranging from about 100° C. to about 450° C. and the pressure and heat are applied for a period of time ranging from about 0.14 seconds to about 10 seconds.

14. The method of claim 8, wherein the application of pressure is at a pressure of about 1400 psi, the application of heat is at a temperature of about 350° C. and the pressure and heat are applied for a period of time of about 0.7 seconds.

15. The method of claim 9, wherein the application of pressure is at a pressure of about 1400 psi, the application of heat is at a temperature of about 350° C. and the pressure and heat are applied for a period of time of about 0.7 seconds.

16. A method for dewatering a solid-liquid matrix which does not have a structure comprising:

(1) treating the solid-liquid matrix in a manner such that the weight percent solids content of the solid-liquid matrix increases to a level which provides the solid-liquid matrix with a structure; and (2) simultaneously applying pressure and heat to the solid-liquid matrix resulting from step (1) for a period of time ranging from about 0.01 seconds to about 20 seconds, the application of pressure being at a pressure ranging from about 45 psi to about 6000 psi, and the application of heat being at a temperature ranging from about 21° C. to about 1000° C.

17. The method of claim 16, wherein the solid-liquid matrix is sludge.

18. The method of claim 17, wherein the sludge is primary sludge.

19. The method of claim 17, wherein the sludge is secondary sludge.

20. The method of claim 17, wherein the sludge is a mixture of primary and secondary sludge.

21. The method of claim 16, wherein the application of pressure is at a pressure ranging from about 45 psi to about 2000 psi, the application of heat is at a temperature ranging from about 100° C. to about 450° C. and the pressure and heat are applied for a period of time ranging from about 0.14 seconds to about 10 seconds.

22. The method of claim 17, wherein the application of pressure is at a pressure ranging from about 45 psi to about 2000 psi, the application of heat is at a temperature ranging from about 100° C. to about 450° C. and the pressure and heat are applied for a period of time ranging from about 0.14 seconds to about 10 seconds.

23. The method of claim 21, wherein the application of pressure is at a pressure of about 1400 psi, the application of heat is at a temperature of about 350° C. and the pressure and heat are applied for a period of time of about 0.7 seconds.

24. The method of claim 22, wherein the application of pressure is at a pressure of about 1400 psi, the application of heat is at a temperature of about 350° C. and the pressure and heat are applied for a period of time of about 0.7 seconds.

25. The method of claim 16, wherein the solid-liquid matrix is treated with a cold press and the pressure and heat are applied to the solid-liquid matrix by an impulse dryer.

26. The method of claim 17, wherein the solid-liquid matrix is treated with a cold press and the pressure and heat are applied to the solid-liquid matrix by an impulse dryer.

27. The method of claim 16, wherein the solid-liquid matrix is treated by combining it with other, more dry materials.

28. The method of claim 17, wherein the solid-liquid matrix is treated by combining it with other, more dry materials.

29. A method for dewatering a solid-liquid matrix which has a structure comprising simultaneously applying pressure and heat to the solid-liquid matrix with an impulse dryer having a press nip for a period of time ranging from about 0.01 seconds to about 20 seconds, the application of pressure being at a pressure ranging from about 45 psi to about 6000 psi, and the application of heat being at a temperature ranging from about 100° C. to about 450° C.

30. The method of claim 29, wherein the application of pressure is at a pressure of about 1400 psi, the application of heat is at a temperature of about 350° C. and the pressure and heat are applied for a period of time of about 0.7 seconds.

31. A method for dewatering a solid-liquid matrix which does not have a structure comprising:

(1) treating the solid-liquid matrix in a manner such that the weight percent solids content of the solid-liquid matrix increases to a level which provides the solid-liquid matrix with a structure; and (2) simultaneously applying pressure and heat to the solid-liquid matrix resulting from step (1) with an impulse dryer having a press nip for a period of time ranging from about 0.01 seconds to about 20 seconds, the application of pressure being at a pressure ranging from about 45 psi to about 6000 psi, and the application of heat being at a temperature ranging from about 100° C. to about 450° C.

32. The method of claim 31, wherein the application of pressure is at a pressure of about 1400 psi, the application of heat is at a temperature of about 350° C. and the pressure and heat are applied for a period of time of about 0.7 seconds.

* * * * *